US009361796B2

(12) United States Patent
Mendez Falcato

(10) Patent No.: US 9,361,796 B2
(45) Date of Patent: Jun. 7, 2016

(54) SYSTEM AND METHOD FOR MONITORING PEOPLE AND/OR VEHICLES IN URBAN ENVIRONMENTS

(75) Inventor: Marti Mendez Falcato, Barcelona (ES)

(73) Assignee: WORLDSENSING, S.L., Barcelona (ES)

( * ) Notice: Subject to any disclaimer, the term of this patent is extended or adjusted under 35 U.S.C. 154(b) by 818 days.

(21) Appl. No.: 13/056,068

(22) PCT Filed: Jul. 30, 2008

(86) PCT No.: PCT/ES2008/000528
§ 371 (c)(1),
(2), (4) Date: Jan. 31, 2011

(87) PCT Pub. No.: WO2010/012844
PCT Pub. Date: Feb. 4, 2010

(65) Prior Publication Data

US 2011/0128127 A1 Jun. 2, 2011

(51) Int. Cl.
*G08G 1/01* (2006.01)
*G08G 1/0968* (2006.01)

(52) U.S. Cl.
CPC ..... *G08G 1/0104* (2013.01); *G08G 1/096883* (2013.01)

(58) Field of Classification Search
CPC ..... G08G 1/0104; G08G 1/096883
USPC ..... 340/933, 935, 936, 988–994, 10.1, 340/539.11, 539.13
See application file for complete search history.

(56) References Cited

U.S. PATENT DOCUMENTS

| | | | | |
|---|---|---|---|---|
| 6,411,889 | B1 * | 6/2002 | Mizunuma et al. | 701/117 |
| 6,505,114 | B2 * | 1/2003 | Luciani | 701/117 |
| 6,972,677 | B2 * | 12/2005 | Coulthard | 340/531 |
| 7,034,690 | B2 * | 4/2006 | Chaco | 340/573.1 |
| 7,164,354 | B1 * | 1/2007 | Panzer | 340/539.15 |
| 7,197,320 | B2 * | 3/2007 | Joseph | 455/456.1 |

(Continued)

FOREIGN PATENT DOCUMENTS

| | | | |
|---|---|---|---|
| EP | 1 555 541 | A2 | 7/2005 |
| WO | 2005/080689 | A2 | 9/2005 |
| WO | 2007/024283 | A1 | 3/2007 |

OTHER PUBLICATIONS

International Search Report for corresponding Patent Application No. PCT/ES2008/000528 dated Apr. 29, 2009.

(Continued)

*Primary Examiner* — Steven Lim
*Assistant Examiner* — Kam Ma
(74) *Attorney, Agent, or Firm* — Renner, Otto, Boisselle & Sklar, LLP

(57) ABSTRACT

System which comprises a plurality of devices for acquiring (1) identifiers of transmitter devices (2) by means of radio frequency in the 2.4 GHz band, these acquisition devices (1) being connected to a central management computer (3) for sending the captured identifiers of the transmitter devices (2) in form of tags (32) in order to include the latter in a database (31). The method comprises the stages of: —acquiring the identifier of the transmitter devices (2) at particular points; —extracting the exclusive part; —encrypting said exclusive part in a tag (32); —sending the tag (32), acquisition point and time (33) to a database (31) of a central computer (3); —comparing the tag (32) and time (33) with the previously stored data in the database (31).

11 Claims, 2 Drawing Sheets

(56) References Cited

U.S. PATENT DOCUMENTS

| | | | | |
|---|---|---|---|---|
| 7,522,995 | B2 * | 4/2009 | Nortrup | 701/425 |
| 7,646,330 | B2 * | 1/2010 | Karr | 342/44 |
| 8,280,617 | B2 * | 10/2012 | Young et al. | 701/119 |
| 8,494,759 | B2 * | 7/2013 | Hada | 701/117 |
| 8,519,868 | B2 * | 8/2013 | Nadeem et al. | 340/933 |
| 8,699,370 | B2 * | 4/2014 | Leung et al. | 370/252 |
| 9,014,632 | B2 * | 4/2015 | Peterson | 455/41.2 |
| 2002/0077750 | A1 * | 6/2002 | McDonald et al. | 701/213 |
| 2002/0107634 | A1 * | 8/2002 | Luciani | 701/117 |
| 2004/0036623 | A1 * | 2/2004 | Chung | 340/825.49 |
| 2004/0217864 | A1 * | 11/2004 | Nowak et al. | 340/572.1 |
| 2005/0119035 | A1 * | 6/2005 | Miyano et al. | 455/575.7 |
| 2005/0140507 | A1 * | 6/2005 | Nam et al. | 340/539.13 |
| 2005/0200476 | A1 * | 9/2005 | Forr et al. | 340/539.13 |
| 2006/0055564 | A1 * | 3/2006 | Olsen et al. | 340/994 |
| 2006/0071790 | A1 | 4/2006 | Duron et al. | |
| 2006/0267731 | A1 * | 11/2006 | Chen | 340/10.1 |
| 2006/0288796 | A1 * | 12/2006 | Giazotto | 73/800 |
| 2007/0028233 | A1 * | 2/2007 | Miller | 717/174 |
| 2007/0152812 | A1 * | 7/2007 | Wong et al. | 340/539.12 |
| 2008/0002031 | A1 * | 1/2008 | Cana et al. | 348/208.14 |
| 2008/0069024 | A1 * | 3/2008 | Iino | H04L 12/4633 370/313 |
| 2008/0094212 | A1 * | 4/2008 | Breed | 340/541 |
| 2008/0211670 | A1 * | 9/2008 | Gordon | 340/572.1 |
| 2009/0210141 | A1 * | 8/2009 | Young et al. | 701/119 |
| 2009/0307091 | A1 * | 12/2009 | Lilley | 705/14.58 |
| 2010/0254282 | A1 * | 10/2010 | Chan et al. | 370/253 |
| 2011/0128127 | A1 * | 6/2011 | Falcato | 340/10.1 |
| 2011/0156924 | A1 * | 6/2011 | Nadeem et al. | 340/905 |
| 2015/0236952 | A1 * | 8/2015 | Liang | H04L 61/2596 370/230 |
| 2015/0236985 | A1 * | 8/2015 | Chandramouli | H04L 49/9057 370/328 |

OTHER PUBLICATIONS

International Preliminary Report on Patentability for corresponding Patent Application No. PCT/ES2008/000528 dated Sep. 29. 2010 and partial English translation.

* cited by examiner

SYSTEM AND METHOD FOR MONITORING PEOPLE AND/OR VEHICLES IN URBAN ENVIRONMENTS

OBJECT OF THE INVENTION

The present invention relates to a system and method for monitoring persons and/or vehicles in urban environments.

BACKGROUND OF THE INVENTION

Monitoring and controlling the transit of people and/or vehicles in urban environments has currently become an issue of crucial importance to municipal and urban authorities. This monitoring does not only affect the transit of automobiles in the streets of a city, at certain points where traffic jams or dense traffic can occur, but also affects the deployment of traffic agents, cleaning services and other services during the daily life of the city. This also affects the displacement of people in large groupings and events or in their daily travels to their workplace.

Up to now, vehicle traffic was monitored practically in a statistical manner, using devices to count the vehicles that travel on a street during a certain period of time, such as car counter cables in the pavement, radar devices of video-surveillance cameras. After gathering the data at different points in the city, a crossed statistical analysis is performed with the position information of the measurement points. However, this information is confusing, as it does not consider the variation of vehicle flow rates during rush hours or on different days of the week (vehicles are often counted during one or two days to obtain a sufficient reliability of the sample), and results are obtained at a time that is too late for municipal authorities to make immediate or short-term decisions.

On another hand, controlling transit of people is more difficult, and is generally performed by installing turnstiles in office buildings or by approximate head counts using video and photographic cameras. However, the results obtained are highly localised and can vary considerably depending on the time and conditions of the sample.

The Traffic Measurement System (TMS) of the company Intellione is known, which uses the signal from mobile telephones to position people and vehicles in motion. Considering that in modern cities it is common for a large percentage of people to carry mobile telephones that are turned on during their daily activities, the communication signal of this telephone positions the person, whether moving in a vehicle or walking. Thus, the TMS system allows knowing the movement of people using the mobile telephony antenna network of the operators present in a city or urban area. This information can be processed in real time and is apparently reliable.

However, it has certain drawbacks. Firstly, the telephones must be positioned by triangulating antennas, as the coverage of an antenna can be quite large (up to several kilometers), so that it is harder to determine whether the location is a given street or an adjacent one. Secondly, the problem also exists that the antennas are positioned according to the coverage needs of the telephony service, so that they cannot provide an optimised distribution for studying traffic in a specific area, and its use is very difficult inside a building or a medium or small-sized installation. Thirdly, there is the problem of confidentiality, as the mobile telephone identifiers leave the network of the telephone operator in order to be processed, so that there is a risk of violating personal privacy.

DESCRIPTION OF THE INVENTION

The system and method for monitoring people and/or vehicles in urban environments object of this invention presents certain technical characteristics meant to allow studying traffic in real time, such as in the streets of a city or the like or in a large building, in order to optimise the possible actions on mobility and transportation.

Thus, the system comprises a plurality of devices for acquiring identifiers of transmitter devices by means of radio frequency in the 2.4 GHz band, these acquiring devices being connected to a central management computer for sending the captured identifiers of the transmitters in order to include them in a database. This set-up is designed to detect the open signal emitted by the communication devices that operate in the free-use frequency of 2.4 GHz. Among these devices are those that use Bluetooth, Wifi, Zigbee and others. In general, devices for connection to local or personal wireless networks, which emit their MAC identification in this signal, which can be captured due to their free access when the device is active, as it forms part of the connection protocol.

The number of active transmitters is guaranteed, given their great evolution in the market, for example, in 2007 87% of mobile telephones sold already included Bluetooth technology, and its popularity has increased by the extensive implementation of hands-free devices in automobiles.

Each acquiring device comprises a short-range multi-format transducer for the 2.4 GHz band, at least one transmitting and receiving antenna, one operation and encryption processor, one long-range telecommunications device and one power supply.

The transducer and antenna sweep the coverage area and range of the acquiring device in search of active transmitting devices in order to read their identifiers or MAC address. The data of this MAC (media access control) address includes a part defined by the manufacturer and the protocol, which are discarded, and a part that defines exclusively the transmitting device, encrypted with an asymmetrical encryption password that allows preserving its exclusive identification while allowing to manage the information in a confidential manner. Once encrypted, the tag is sent with the acquisition, or capture, time and acquisition point to the central computer.

This central computer comprises a database of already acquired tags with the acquisition time and geographical position of the corresponding acquiring device, so that when new tags are received they are compared with previously stored tags and the monitoring data are obtained, as will be described further below.

The acquiring device is housed inside a weatherproof casing, allowing it to be installed in any location according to the needs of the area to be monitored.

Considering the type of transmitting device to which the acquiring devices connect, the operational range of the transducer is less than 50 meters, preferably from 2 to 35 meters. This allows limiting the acquisition operation to the width of a street or avenue, avoiding the acquisition of transmitters of people travelling on adjacent streets, as occurs when using mobile telephony signals or those with greater coverage. Moreover, these acquiring devices allow monitoring flow in hallways or accesses in buildings or installations without requiring different turnstiles or counters.

It has been foreseen that in one embodiment the acquiring device comprises two transducers, with their corresponding antennas, separated from each other, for example along the street in which this acquiring device is installed, thereby allowing to detect the direction of motion, or by the analysis of the signal intensity (RSSI) which is already incorporated in the protocols of these transmitters.

To achieve a greater autonomy of the acquiring devices, the power supply comprises a photovoltaic panel and batteries, allowing their installation without having to consider the electrical grid supply.

As mentioned above, in the system the tags bear a reference to the location where the transmitters were captured. This reference can be obtained manually at the time of installing the acquiring devices, as they do not move, or by fitting the acquiring device with a positioning device such as a global positioning system (GPS) device that allows automatic reutilisation in any other acquisition point without set-up problems.

The telecommunications device comprises preferably an Internet connection, either by cable or wireless (WiFi), although direct connections such as mobile telephony, or others, are not ruled out.

Thus, the method of operation of the system comprises the following stages:

- acquiring at particular points the identifiers of the transmitter devices in the 2.4 GHz band that enter the radius of action of the acquiring devices installed;
- extracting at least the exclusive part of the identifier from the identifier;
- encrypting said exclusive part of the identifier in a unique tag;
- sending the unique tag, the identifier of the acquisition point and the acquisition time by the acquiring point to a computer for its incorporation and processing in a database.
- comparing in the database the tag and corresponding time with the previously stored data to determine whether the transmitter device has previously been in a different acquisition point, thereby calculating the conditions of its motion and traffic based on the time difference and the distance between the two acquisition points.

This comparison can be used to obtain results practically in real time on the motion of the transmitters, and therefore on the people and the vehicles in which they travel. These data can be filtered by speed, so that a tag moving at a low speed can in principle be a person on foot or a local resident, while a tag moving at a certain speed (for example, 8 kilometers per hour) is a still vehicle, while a tag moving at a high speed is a vehicle moving in fluid traffic. Likewise, a high flow rate of tags past a point implies a high flow of vehicles or people, while a low flow rate of tags past an acquisition point implies low transit, for example at night. Crossing the tag data with the position map of the acquisition points even allows identifying whether the transit corresponds to people who work in the area (the tag is generated at a given acquisition point early in the morning and appears again late in the afternoon repeatedly during weekdays) or is a resident (the tag is generated constantly and randomly during the day).

It has been foreseen that the identification of the device is the public part of the MAC address of the device, which can be accessed by any device that attempts connection, such as the multi-format transducer, to allow receiving the Bluetooth, WiFi or Zigbee signals.

To ensure that the data of this public part cannot be used fraudulently it has been foreseen that the encryption be performed by asymmetrical cryptography, so that the acquiring device have a public code which, when converting the data of the public part to the tag that is sent, ensures privacy, while allowing each transmitter to be identified in a unique manner at all times.

The comparison comprises classifying tags according to the calculated speed of travel of the corresponding transmitter device between two acquisition points. All of these data can be looked up in real time and displayed graphically on a map, which can be filtered so that the different municipal services, such as police, cleaning services, works and others can carry out actions in real time, simply by linking to the central computer via the Internet.

DESCRIPTION OF THE FIGURES

To complete the description being made and in order to aid the comprehension of the characteristics of the invention, the present descriptive memory is accompanied by a set of drawings where, for purposes of illustration only and in a non-limiting sense, the following is shown.

PREFERRED EMBODIMENT OF THE INVENTION

Figure 1:
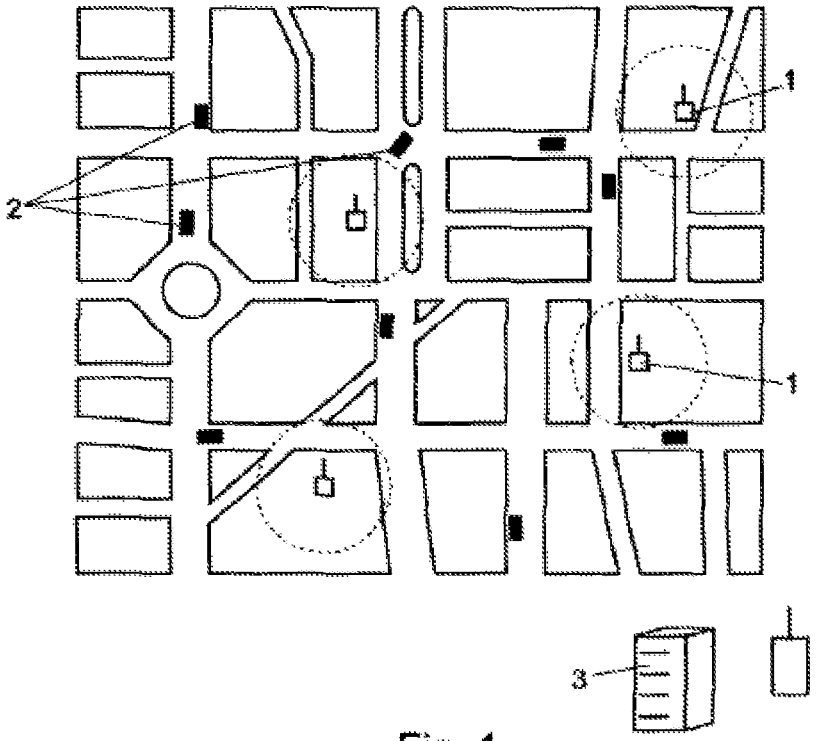
FIG. 1 shows a block diagram of the system distributed on the map of a city.
Figure 2:
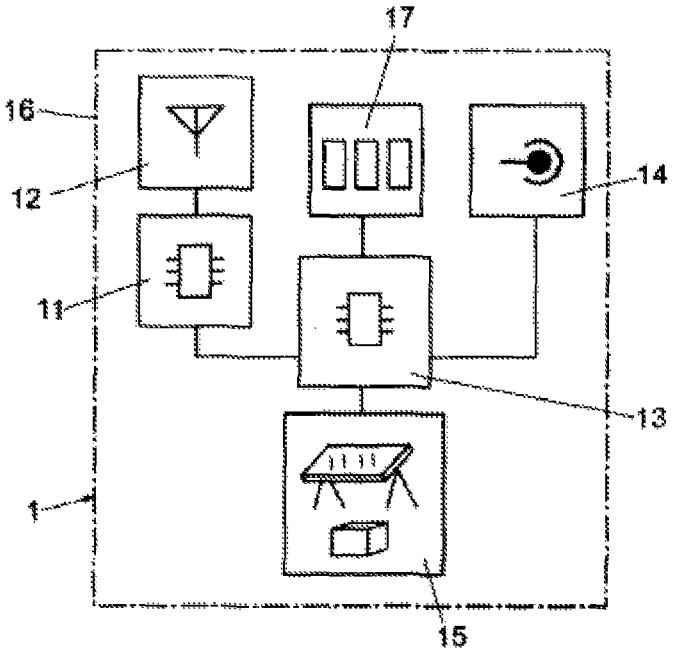
FIG. 2 shows a block diagram of an embodiment of the acquiring device.
Figure 3:
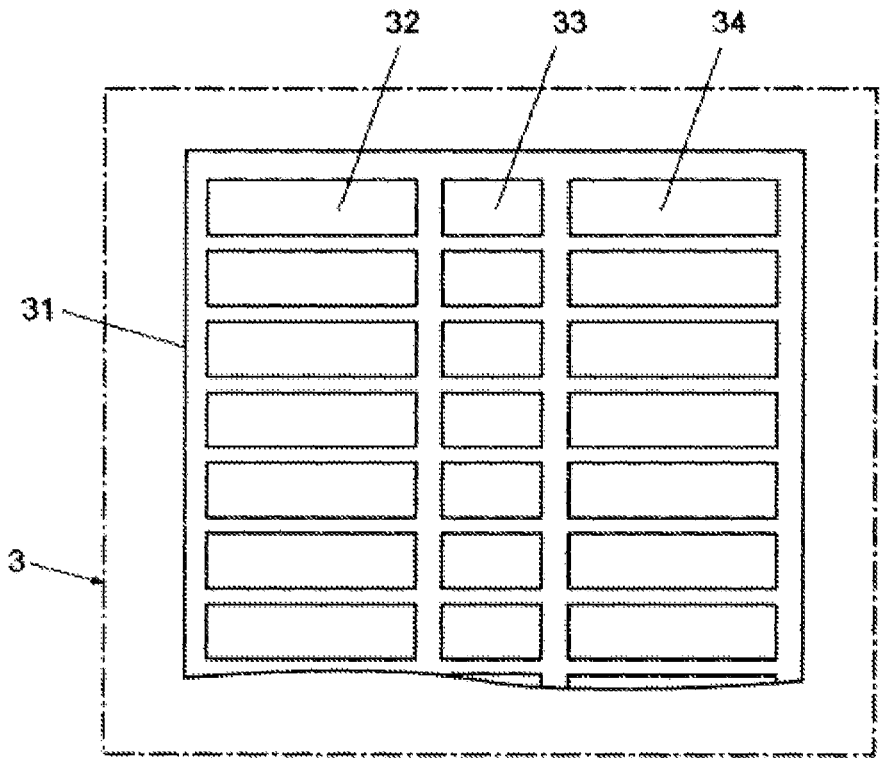
FIG. 3 shows a block diagram of an embodiment of the database in the central computer.

As shown in the aforementioned figures, the system comprises a plurality of acquiring devices (1) distributed within the urban area to be monitored to capture the MAC identifiers of the various active communication transmitter devices (2) using the 2.4 GHz band, such as devices fitted with Bluetooth, WiFi or Zigbee that pass through the areas of influence of said acquiring devices (1). These transmitter devices (2) are mainly personal devices of the people and vehicles in transit, such as mobile telephones, laptop PCs, PDA's, GPS navigators and other communication and remote control devices. The various acquiring devices (1) are connected to a central computer (3) that receives the data generated in each one to include them in a database (31), in this case MySQLServer, and generate practical results.

Each acquiring device (1) comprises a short-range multi-format transducer for the 2.4 GHz band with its corresponding antenna (12), this range being no greater in this case than 50 meters, or less, in order to cover the width of a street or avenue. This transducer (11) is associated with an operation processor (13) which separates and encrypts the identifier of the MAC address captured in a secure tag (32) that is sent with time data (33). In turn, the processor (13) is connected via a long-range telecommunications device (14) to the central computer (13), in this case the telecommunications device (14) being an Internet cable connection module. The acquiring device (1) comprises a power supply (15) for the entire electrical system. All these components are protected within a weatherproof external casing (16) allowing them to be placed in any outdoor location considered necessary. The said power supply (15) comprises a photovoltaic panel and batteries that allow a fully autonomous operation of the acquiring device (1).

In one embodiment the acquiring device (1) comprises a global positioning module (17), or GPS, so that this acquiring device (1) can transmit the exact position (34) of its location with the tag (32).

Having described the nature of the invention sufficiently, as well as an example of a preferred embodiment, it is noted for the applicable purposes that the materials, shape, size and arrangement of the elements described can be modified provided this does not imply altering the essential characteristics of the invention as claimed below.

The invention claimed is:

1. A system for monitoring people and/or vehicles by using existing personal portable communication devices, the system comprising a central management computer; a plurality of acquiring devices for acquiring identifiers of transmitter devices by radio frequency in the 2.4 GHz band, which transmitter devices are the existing personal portable communication devices carried by people and/or vehicles primarily for use independent of the system, the acquiring devices being connected to the central management computer for sending the acquired identifiers of the transmitter devices in the form of tags for incorporation in a database; and wherein each acquiring device comprises a short-range multi-format transducer in the 2.4 GHz band, at least one transmission and reception antenna, a processor for operation and encryption, configured for the extraction and encryption of the exclusive public part of the Medium Access Control (MAC) address of the transmitter devices as the identifier of the transmitter devices in an encrypted, unique tag, a long-range telecommunications device and an electrical power source; and wherein the central management computer comprises the database of the encrypted, unique tags with acquisition times and geographical positions of the corresponding acquiring devices.

2. The system according to claim 1, wherein the acquiring device is housed within a weatherproof casing.

3. The system according to claim 1, wherein the operational range of the transducer is less than 50 meters.

4. The system according to claim 1, wherein the acquiring device comprises two transducers with their corresponding antennae separated from each other to detect the direction of motion of the transmitter device captured.

5. The system according to claim 1, wherein the acquiring device comprises a global positioning device.

6. The system according to claim 1, wherein the telecommunications device is an Internet connection.

7. A method for monitoring transmitter devices of people and/or vehicles by using existing personal portable communication devices, the method comprising the steps of using acquiring devices to acquire at certain acquisition points identifiers of the transmitter devices in the 2.4 GHz band that enter an operational range of the acquiring devices, wherein the transmitter devices are the existing personal portable communication devices carried by people and/or vehicles primarily for use independent of the method; extracting and encrypting the exclusive public part of the Medium Access Control (MAC) address of the transmitter devices as the identifier of the transmitter devices in an encrypted, unique tag; sending the encrypted, unique tag, acquisition point identifier and acquisition time from the acquiring device to a central computer for inclusion and processing in a database; comparing in the database the encrypted, unique tag and the acquisition time corresponding with previously stored data in order to determine whether the transmitter device has previously been in another acquisition point, thereby calculating conditions of the transmitter device's motion and traffic based on time difference and distance between the two acquisition points.

8. The method according to claim 7, wherein the encryption is performed by asymmetrical cryptography.

9. The method according to claim 7, wherein the comparison comprises classifying the tags according to the speed of motion calculated for the corresponding transmitter device between two acquisition points.

10. The method according to claim 7, wherein active transmitting devices are searched in the operational range of the acquiring device by the transducer and antenna.

11. The system according to claim 1, wherein active transmitting devices are searched in the operational range of the acquiring device by the transducer and antenna.

* * * * *